US008323039B2

(12) United States Patent
Lippert et al.

(10) Patent No.: US 8,323,039 B2
(45) Date of Patent: Dec. 4, 2012

(54) CONTACT ELEMENT

(75) Inventors: Hans Lippert, Lauterbach (DE); Henrik Neuweger, Herborn (DE); Ulrich Ringleb, Pohlheim (DE)

(73) Assignee: Schunk Kohlenstofftechnik GmbH, Heuchelheim (DE)

( * ) Notice: Subject to any disclaimer, the term of this patent is extended or adjusted under 35 U.S.C. 154(b) by 0 days.

(21) Appl. No.: 12/040,790

(22) Filed: Feb. 29, 2008

(65) Prior Publication Data

US 2008/0214032 A1 Sep. 4, 2008

(30) Foreign Application Priority Data

Mar. 1, 2007 (DE) ..... 20 2007 003 159 U

(51) Int. Cl.
*H01R 25/00* (2006.01)

(52) U.S. Cl. ..... 439/110; 439/121

(58) Field of Classification Search ..... 439/736, 439/110, 121, 162; 200/252, 264, 266, 262
See application file for complete search history.

(56) References Cited

U.S. PATENT DOCUMENTS

| | | | | |
|---|---|---|---|---|
| 3,871,730 | A * | 3/1975 | Hesse | 439/115 |
| 4,074,924 | A * | 2/1978 | Lebecque | 439/1 |
| 4,245,726 | A * | 1/1981 | Kohler | 191/23 A |
| 4,773,869 | A * | 9/1988 | Smart et al. | 439/120 |
| 4,892,986 | A * | 1/1990 | Watanabe et al. | 218/126 |
| 5,342,204 | A * | 8/1994 | Och | 439/39 |
| 5,364,714 | A * | 11/1994 | Gurtler | 429/178 |
| 5,664,953 | A * | 9/1997 | Reylek | 439/111 |
| 6,059,582 | A * | 5/2000 | Tsai | 439/121 |
| 6,255,687 | B1 * | 7/2001 | Figura et al. | 257/309 |
| 6,722,918 | B2 * | 4/2004 | McCoy | 439/533 |
| 6,854,988 | B2 * | 2/2005 | Marmaropoulos et al. | 439/110 |
| 7,083,437 | B2 * | 8/2006 | Mackness | 439/110 |
| 7,291,797 | B2 * | 11/2007 | Yang | 200/547 |
| 7,294,570 | B2 * | 11/2007 | Elliott et al. | 438/653 |
| 7,503,778 | B2 * | 3/2009 | Lehman et al. | 439/110 |
| 2004/0121622 | A1 * | 6/2004 | Abouchar | 439/13 |
| 2007/0023272 | A1 * | 2/2007 | Aisenbrey | 200/341 |
| 2008/0319296 | A1 * | 12/2008 | Bernstein et al. | 600/365 |

FOREIGN PATENT DOCUMENTS

| | | | |
|---|---|---|---|
| DE | 694 484 | | 7/1940 |
| DE | 38 21 255 | A1 | 12/1989 |
| DE | 694 05 700 | T2 | 2/1998 |
| DE | 696 19 473 | T2 | 10/2002 |
| JP | 2003324805 | A | 11/2003 |
| TW | 416143 | B * | 12/2000 |

OTHER PUBLICATIONS

Search Report dated Oct. 25, 2007 for counterpart German Utility Model Application No. 20 2007 003 159.9 filed on Mar. 1, 2007, pp. 4 total.

* cited by examiner

*Primary Examiner* — Renee S Luebke
*Assistant Examiner* — Larisa Z Tsukerman
(74) *Attorney, Agent, or Firm* — Blakely, Sokoloff, Taylor & Zafman LLP

(57) ABSTRACT

The invention concerns a contact element (10) with a sliding contact element (11) for fitting flush against an electrically conductive rail and a support element (12) for connecting the sliding contact to a contact plug (13), which serves as a connector to an electric conductor, wherein the sliding contact element, the support element, and the contact plug are parts of a molded part which is constructed as a single unit.

4 Claims, 1 Drawing Sheet

CONTACT ELEMENT

CROSS-REFERENCE TO RELATED APPLICATIONS

The present patent application claims priority from German Utility Model Patent Application No. 20 2007 003 159.9, filed on Mar. 1, 2007.

BACKGROUND OF THE INVENTION

The invention relates to a contact element having a sliding contact element for fitting flush against an electrically conductive rail and a support element for connecting the sliding contact to a contact plug, which serves as a connector to an electric conductor.

Contact elements of such kind are used for making an electrically conductive sliding contact between a movable consumer and a current supply that is normally installed so as to remain stationary, independently of the consumer. The known contact elements are usually constructed such that a copper plug or a copper plate with an attached contact plug is soldered into the contact element.

In a first operation to produce such contact elements, the sliding contact element is manufactured as a compression molded part and then in a machining or abrasive process a recess is formed in the sliding contact element for installing the support element, which is in the form of a copper plate. The support element not only serves as the supporting structure for the contact element but also enables the contact plug to be formed and connected. In order to produce a stable soldered connection, that is one that is capable of sustaining a mechanical load, between the support element and the sliding contact element, the contact surface between the contact element and the support element must usually be copperplated by galvanising.

Accordingly, a large number of manufacturing and machining steps are required in order to produce contact elements that are fabricated conventionally, and correspondingly sophisticated production machinery which is built to perform these manufacturing and machining steps.

SUMMARY OF THE INVENTION

The object of the present invention is to suggest a contact element that is simple to manufacture.

This object is solved by a contact element having the features of claim 1.

In the contact element according to the invention, the sliding contact element, the support element, and the contact plug are all parts of a molded part which is constructed as a single unit.

The inventive construction of the contact element thus enables the contact element to be manufactured in a single production step, in which the contact element may be produced as a compression molded part from a suitable material composition, for example a mixture of carbon particles and copper particles, in a single molding cycle.

It has proven particularly advantageous if the material composition of the sliding contact element differs from that of the support element, so that the respective material composition may be selected according to the functionality of the various portions of the contact element.

Particularly in order to improve the solderability of the contact plug that is intended for connection to an electric conductor, it has proven advantageous if the contact plug has a different material composition than that of the support element. At the same time, the material composition of the support element may be adjusted such that it is particularly capable of fulfilling its mechanical support function, with the associated resilience requirements.

If the contact plug and the sliding contact element are of the same material composition, a contact element may be produced from just two different material compositions or material ingredients in a known multilayer molding cycle by means of a two-component charging system.

Regardless of whether the sliding contact element, the support element, or the contact plug have a material composition that is essentially uniform, except for any topical variations, or material compositions that differ at least in part, the material composition chosen may be homogeneous, so that the material composition may be supplied without any special dispensing equipment.

However, if necessary it may prove advantageous if the sliding contact element, the support element, or the contact plug has a gradient incorporated into the material composition, in order to satisfy special requirements.

For example, it should be considered particularly advantageous if the material composition of the contact plug incorporates a gradient such that a greater concentration of the components in the material composition that affect solderability is present in the free end of the contact plug.

The contact element is rendered suitable for use in a particularly wide range of applications if at least sections of the contact plug have a circular cross section in the direction of the current flow, so that it is possible to ensure uniform wettability over the circumference of the of the contact plug at least in certain sections, for example as a favourable prerequisite for creating a soldered connection. Moreover, if the plug has a circular cross section at least in the contact area, it is particularly simple to mate a contact plug with a contact socket and to avoid complicating the setup for the connection operation with relative angles of rotation about the connection axis.

In a particularly simple embodiment, the contact plug is constructed as a cylindrical pin.

BRIEF DESCRIPTION OF THE DRAWINGS

A preferred embodiment of the contact plug will be explained in greater detail in the following with reference to the drawing.

In the drawing.

DETAILED DESCRIPTION OF THE INVENTION

Figure 1:
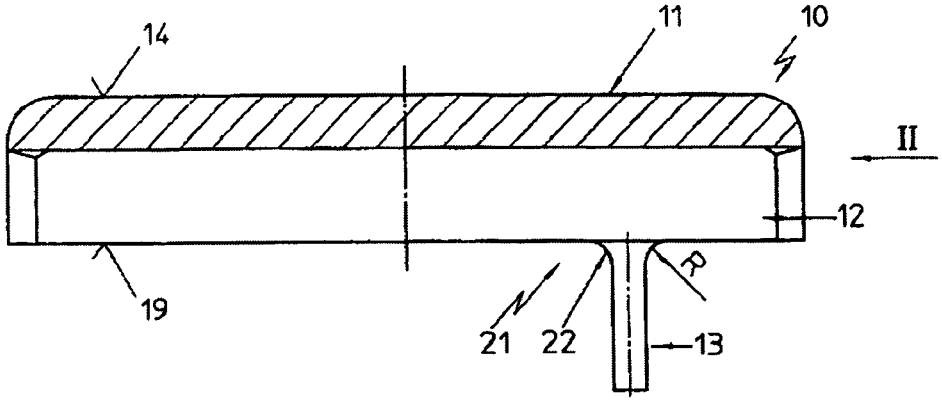
FIG. 1 is a side view of a contact element.

FIG. 1 shows a contact element 10 having a sliding contact element 11, a support element 12, and a contact plug 13. Contact element 10 is manufactured as a single, compression molded part in a compression molding cycle.

In the embodiment of FIG. 1, sliding contact element 11 is made from a first material composition, for example a material composition including a copper component of about 90% with the remainder being carbon. Support element 12, which must essentially fulfill the functions of providing support and assuring an electrically conductive connection between contact plug 13 and sliding contact 11, consists in this case of "electrolyte copper", and is thus more resilient than sliding contact element 11. Because it is intended to assure sliding contact with an electrically conductive rail, which is not shown here, and is in sliding contact therewith for that purpose, sliding contact element 11 is constructed from rather softer material than support element 12, most importantly to allow the desired adaptation of contact surfaces between a contact surface 14 of sliding contact element 11 and the electrically conductive rail, which is not shown here.

Figure 2:
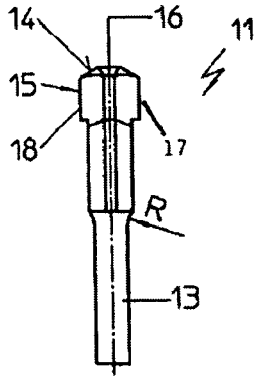
FIG. 2 shows the contact element of FIG. 1 as seen along line II.

As is shown in FIG. 2, sliding contact element 11 is also provided with a profile contour 15 which leads to the creation of wearing contact shoulders 17 and 18 on either side of a longitudinal midplane 16 of contact element 10 after a period of use.

As is shown in FIGS. 1 and 2, support element 12 is attached to and materially bonded with sliding contact element 11, and contact plug 13 extends along lower longitudinal edge 19 of the support element. In the example shown, contact plug 13 is constructed of the same material and is materially bonded to support element 12, and consequently has exactly the same material composition as support element 12.

Figure 3:
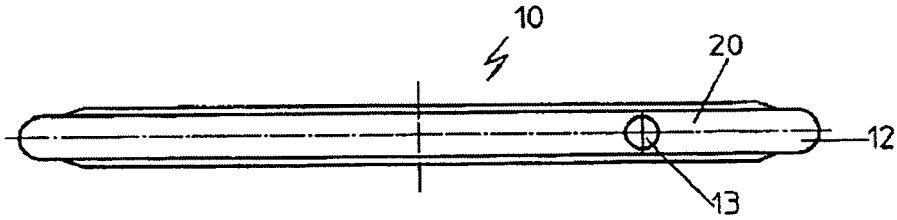
FIG. 3 is a bottom view of the contact element of FIG. 1.
Figure 4:
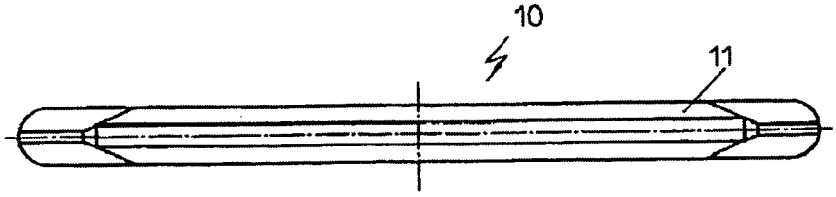
FIG. 4 is a plan view of the contact element of FIG. 1.

As is shown particularly clearly in FIG. 3, contact plug 13 is constructed in the form of a cylindrical pin and has a circular cross section 20. In order to reduce the notching effect in a cross section transition 21 between contact plug 13 and support element 12, a transition collar 22 is formed in the area of cross section transition 21, and in the example shown the collar has a transition radius R. In order to form transition collar 22, circular cross section 20 of contact plug 13 is designed to be smaller than width b of support element 12.

What is claimed:

1. An electrically conductive contact element, comprising:

a compression molded electrically conductive part formed in a single molding step, wherein the single molded part comprises:

a sliding electrical contact portion for fitting flush and sliding against an electrically conductive rail, wherein the sliding contact electrical portion is disposed at one end of the compression molded electrically conductive part;

a contact pin portion that serves as a connector to an electric conductor, wherein the contact pin portion is disposed at another end of the compression molded electrically conductive part; and a support portion for electrically connecting the sliding electrical contact portion to the contact pin portion, wherein the support portion is attached to and materially bonded to the sliding electrical contact portion, wherein the support portion and the contact pin portion have the same material composition, wherein the sliding electrical contact portion has a material composition differing from that of the support portion and the contact pin, and wherein the contact pin portion is materially bonded to the support portion.

2. The contact element as recited in claim 1, wherein the sliding electrical contact element, the support portion, or the contact pin portion has a gradient of material concentration of the components in the material composition thereof.

3. The contact element as recited in claim 2, wherein the material composition of the contact pin portion incorporates a gradient such that a greater concentration of the components in the material composition that affect solderability is present in the free end of the contact pin portion.

4. The contact element as recited in claim 1, wherein at least sections of the contact pin portion have a circular cross section in the direction of the current flow.

* * * * *